United States Patent [19]

Johnson

[11] 3,953,288

[45] Apr. 27, 1976

[54] GAS VENTING

[75] Inventor: Edwin F. Johnson, Albuquerque, N. Mex.

[73] Assignee: The United States of America as represented by the United States Energy Research and Development Administration, Washington, D.C.

[22] Filed: Mar. 24, 1970

[21] Appl. No.: 24,895

[52] U.S. Cl. ..... 176/79; 176/82; 250/436; 250/437; 250/506

[51] Int. Cl.[2] ..... G21H 5/00; G21C 3/10

[58] Field of Search ..... 250/106 S, 436, 437, 250/506; 176/79, 82; 136/202

[56] References Cited

UNITED STATES PATENTS

| | | | |
|---|---|---|---|
| 2,830,190 | 4/1958 | Karp | 250/106 S |
| 3,133,196 | 5/1964 | Rochlin | 250/106 S |
| 3,324,540 | 6/1967 | Lotts et al. | 176/79 X |
| 3,357,893 | 12/1967 | Gatley et al. | 176/79 X |
| 3,406,094 | 10/1968 | Beisswenger | 176/79 |
| 3,633,033 | 1/1972 | Cottam | 250/106 S |

OTHER PUBLICATIONS

Stockel, Auto Mechanics Fundamentals, Goodheart-Willcox Company, Inc., 1969, p. 105.

*Primary Examiner*—Nelson Moskowitz
*Attorney, Agent, or Firm*—Dean E. Carlson; Dudley W. King; Richard E. Constant

[57] ABSTRACT

Improved gas venting from radioactive-material containers which utilizes the passageways between interbonded impervious laminae.

4 Claims, 5 Drawing Figures

INVENTOR.
EDWIN F. JOHNSON

BY
Roland A. Anderson
Attorney

GAS VENTING

BACKGROUND OF INVENTION

Many applications which require some source of heat utilize alpha-emitting radioactive fuel elements or capsules which are fueled with radioisotopes such as plutonium-238, polonium-210, curium-244, americium-241, neptunium-237 or the like. These isotopic fuel elements or capsules may be used for thermoelectric, thermionic, and other power conversion units or simply as heat sources for space or the like applications. In the alpha decay of these radioisotopes, alpha particles are emitted which in turn may acquire electrons to become complete helium molecules. Such helium or alpha particles, in time, may build up undesirably high pressures within the fuel element or capsule containment vessel. In many applications, a radioactive fuel element or capsule may operate at elevated temperatures, such as at about 3,600°F and higher, which may further increase helium pressure within the heat source container and cause material weakening of the housing of containment vessel walls. Consequently, materials which have high strength at high temperatures are used for enclosing such alpha and helium producing radioisotopes and frequently, double walls of thick, high strength material are desirable to minimize or prevent rupture and escape of the radioactive isotopes. The additional weight resulting from the use of such containment vessels may present a difficult problem in rocket and space vehicle applications as well as other uses where excess weight is undesirable.

The helium so generated may be vented or released from the containment vessel to a pressure chamber and/or to the atmosphere. Under normal usage, the helium may be allowed to escape while radioactive elements in the form of fines or other particles must be contained within the containment vessel. A vent or vent system must not only withstand the high temperature and possibly high pressure resulting from the radioactive decay process itself, but must also in space applications and the like be capable of withstanding all possible launch pad environments, such as fireball, heat pulse, explosion, propellant burn, and launch pad impact, and be capable of withstanding reentry impact, vibration, thermal stresses, and corrosion.

Prior radioisotope fuel elements or capsules have employed various porous materials as vents for release of the helium produced therein. Many of these porous materials are of inherently low strength or are unable to withstand the high operating temperatures. Still other materials have thermal characteristics, such as coefficients of thermal expansion, significantly different from the containment vessel materials so that they are subject to rupture or to other failures when subjected to a heat pulse or the like. Still other materials are not able to withstand the corrosive environment presented by the radioisotopic material itself. Further, it has been difficult in many prior vents to reliably predict the porosity and vent rate of the vent or have been very difficult and expensive to manufacture.

SUMMARY OF INVENTION

In view of the limitations of the prior art as noted above, it is an object of this invention to provide a gas vent having high strength and capable of withstanding stringent environmental conditions and method of making same.

It is a further object of this invention to provide a gas vent having high structural strength at elevated temperatures.

It is also an object of this invention to provide a gas vent which is chemically compatible with radioisotopic materials at elevated temperatures.

It is a still further object of this invention to provide a gas vent which may be made of the same or compatible materials as the containment vessel in which the radioisotope fuel is enclosed.

Various other objects and advantages will appear from the following description of embodiments of the invention, and the most novel features will be particularly pointed out hereinafter in connection with the appended claims.

It will be understood that various changes in the details, materials and arrangements of the parts, which have been herein described and illustrated in order to explain the nature of the invention may be made by those skilled in the art.

The invention comprises a gas vent and the method of making same utilizing passageways between coextensive and juxtaposed partially bonded surfaces.

DESCRIPTION OF DRAWING

The present invention is illustrated in the accompanying drawing wherein.

DETAILED DESCRIPTION

Figure 1:
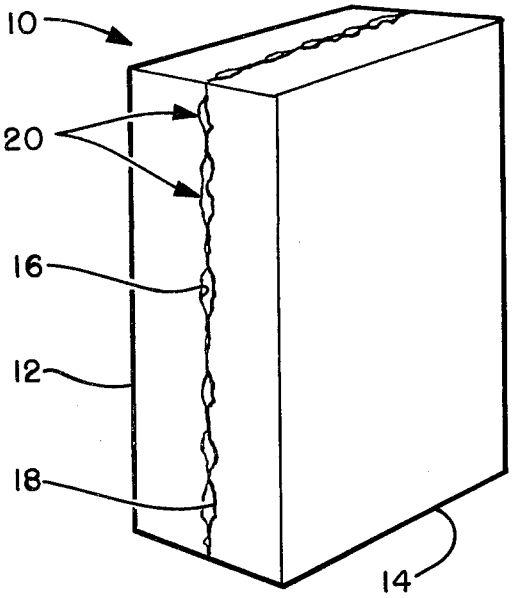
FIG. 1 is an exaggerated perspective view of a gas vent incorporating features of this invention.

The present gas vent provides small micron size gas escape channels or passages by effecting a controlled metallurgical diffusion between layers or sheets of metal to produce a capillary-like network at the layer or sheet interface disposed edgewise to a gas-evolving volume for the gases to pass through. Referring to FIG. 1, there is shown a gas vent 10 formed from a first impervious sheet or lamina 12 disposed adjacent to a second impervious sheet or lamina 14 having mating surfaces 16 and 18 which are coextensive and juxtaposed over the surface areas thereof. Laminae 12 and 14 may be of any desired size and thickness of any appropriate flat or curved configuration so long as the surfaces are coextensive and initially mating or in intimate contact over a substantial or entire portion thereof. In order to achieve the maximum or most effective venting capacity per unit volume, it may be desirable that the mating surface areas be substantially greater than the thickness of the elements. It has been found that if the mating surfaces of laminae 12 and 14, surfaces 16 and 18, are interbonded over a portion of the mating surface area, a multitudinous of minute passageways or channels 20 may be formed between the mating surfaces which connect with other randomly oriented passageways or channels to form a capillary-like network from one edge of the filter to the other. It has further been discovered that these passageways may vary in size from about a few microns, such as about four microns, to about fifteen microns, depending on the bonding parameters used and the surface finish of the elements prior to bonding. For purposes of illustration, the elements and passageways shown in FIG. 1 are of exaggerated thickness and width. In order to achieve the capillary-like network completely through the interface of the mating surfaces of elements 12 and 14, the mating surfaces may be bonded over as little as about 4% of the coextensive surface area up to about 50% or more depending upon the desired vent rate and the materials being used, such as in the range of from about 4 to 10% in the examples below.

The bonding may be carried out at a temperature dependent on the melting point of the metal being used in accordance with known metallurgical practices for the gas vent elements and at a low pressure and time periods dependent upon the desired percentage of area to be bonded. For example, a cobalt-steel alloy having a melting point of about 2,400°to 2,600°F and formed into two mating strips about 0.012 inches thick were bonded for about 1 hour at about 2,150°F under a pressure of about 10 psi in an argon atmosphere. The surfaces to be bonded were initially finished to approximately a number 64 RMS finish and cleaned with an organic solvent. The resulting bond covered between about 4.6 and 9.1% of the available mating surface and presented passageway of about 4 to 12 microns in size.

Any suitable materials may be used for the gas vent of this invention so long as they are capable of controlled diffusion-type or the like bonding. For high temperature uses, it may be desirable to use high strength materials such as cobalt-steel alloys, nickel-chromium-steel, nickel-steel, stainless steel or the like or refractory materials like tantalum and tungsten or their alloys. Such materials may also be particularly compatible with the radioisotopic heat source type environments. Other gas vent materials may include aluminum, iron, copper, or the like.

Figure 2:
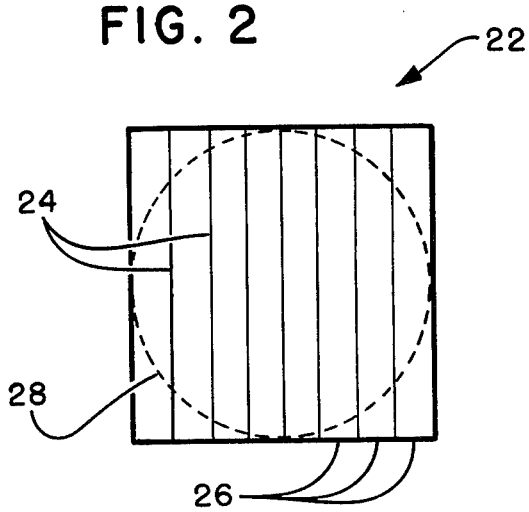
FIG. 2 is a modified version of the vent shown in FIG. 1.

A multilayered gas filter may be constructed by bonding several sheets or layers of impervious laminae together having pervious zones intermediate thereof using appropriate diffusion bonding process parameters. Such a gas vent 22 is shown in FIG. 2 wherein mating surfaces 24 of the stacked laminae 26 are interbonded to form a unitary structure. Gas vent 22 may be left in the configuration shown or machined to circular, rectangular or the like shapes to fit into a desired containment vessel and shape, such as shown by the dotted line 28. The appropriately shaped gas vent 22 may then be sealed to the containment vessel, such as by appropriate electron beam, inert gas or the like welding or by suitable sealants or adhesives.

A gas vent of the type shown in FIG. 2 and constructed from a stack of 23 cobalt-steel alloy sheets about three-eighths by three-eighths inch and 0.012 inch thick in size were bonded at 2,150°F and 10 psi for one hour under vacuum. A vent so constructed was sealed in the passageway of a helium container at 15 psi and coupled to a collection vessel of about 510 cubic centimeters under a vacuum of 4.0 Torr. The vent was sealed to have an opening of about ⅛ inch diameter facing the helium containment vessel. Helium leak rates of about $6.58 \times 10^{-3}$ cubic centimeters per second were achieved. When the helium pressure was increased to 20 psi, leak rates of about $1 \times 10^{-2}$ cubic centimeters per second were achieved. Another similarly prepared gas vent having a smaller venting volume exhibited a leak rate of about $1.2 \times 10^{-5}$ cubic centimeters per second with a pressure differential of about 15 psi to a vacuum of 0.4 Torr into a volume of 45 cubic centimeters. When the helium pressure was increased to 20 psi in this latter test, a leak rate of $1.88 \times 10^{-5}$ cubic centimeters per second was achieved.

Figure 3:
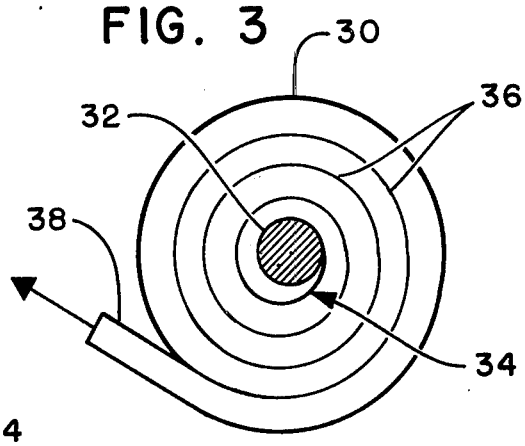
FIG. 3 is still another version of this vent.

A gas vent may also be formed directly in an annular configuration as shown in FIG. 3 by wrapping a sheet or lamina 30 in a coil about a mandrel 32 or about itself. The end 34 of lamina 30 may be suitably attached to mandrel 32 and shaped so as to provide a continuous, intimately contacting, mating surface spiraling from mandrel 32. The free end of lamina 30 may be used to apply pressure to the respective mating surfaces 36 as shown by the force arrow 38 during bonding thereof. Mandrel 32 may be left as a part of the gas vent or it may be removed and the gas vent used as a tubular shaped vent.

Figure 4:
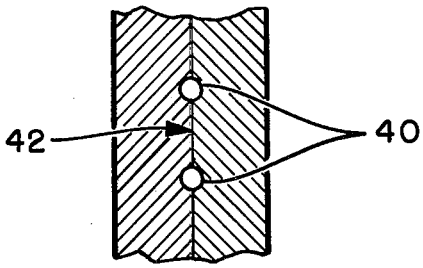
FIG. 4 is a cutaway fragmentary view of another filter arrangement.

Additional control or variations in vent rates may be achieved by lightly etching suitable grooves in the mating surfaces of the gas vent prior to bonding the surfaces together, as shown by channels or grooves 40 in FIG. 4. Mating surfaces 42 may then be completely bonded together to channel all gas flow through grooves 40 or it may be partly bonded as described above, depending upon the desired flow characteristics.

Additional flow control may also be achieved by coating the mating surfaces of the gas vent prior to bonding with an appropriate material, for example, such as quartz, various glasses, palladium alloys or the like that may react with or otherwise impede one gas or material with respect to another. The coating material may completely cover one or more of the surfaces of the elements or be in some matrix or array.

Figure 5:
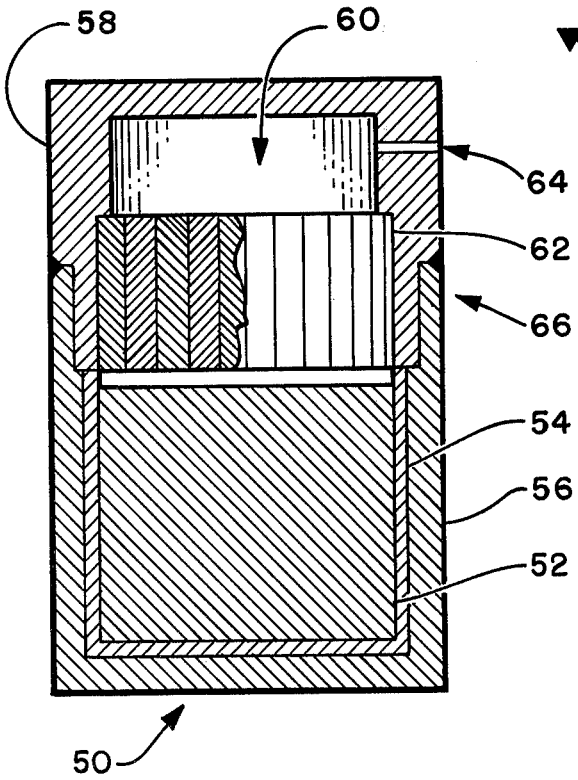
FIG. 5 is a cutaway view of a radioisotopic fuel element, partially in perspective, which includes a vent of the type shown in either FIG. 2 or FIG. 3.

The gas vent of this invention may be mounted in any appropriate manner in a radioistope heat source adjacent to a radioisotopic fuel with the vent passageways communicating with the radioisotopic fuel and a suitable vent gas storage container or to the atmosphere. Such an arrangement is shown in FIG. 5. In FIG. 5, the radioisotopic heat source 50 includes radioisotopic material 52 enclosed within one or more containers 54 and the lower portion 56 or one-half of the containment vessel or capsule. The other portion of the capsule, that is portion 58, may include a gas storage volume 60 and carry a gas vent 62 communicating therewith. Gas vent 62 may be appropriately welded and sealed to portion 58 with the mating surfaces of the lamina aligned edgewise with the direction of gas flow, as shown. If desired, one or more passageways 64 may be provided within portion 58 communicating with volume 60 and with the atmosphere surrounding heat source 50. Portions 56 and 58 of the capsule may be appropriately connected together, welded and sealed by any appropriate overlapping or the like flange arrangement 66. Heat source 50 is shown in an annular configuration though it may be of any other convenient shape. Gas vent 62 may be of the type shown in FIG. 2 or that shown in FIG. 3, with or without the grooves of FIG. 4. Radioisotopic fuel 52 may be any conventional radioisotopic fuel such as plutonium-238 dioxide microspheres, alloys of plutonium-238, polonium-210 or any other conventional alpha emitting radioisotope.

The heat source capsule shown in FIG. 5 may be manufactured and assembled with minimum radiation hazard to assembly personnel. The radioisotopic fuel may be placed in the lower portion of the capsule in a remote handling facility. The upper portion of the capsule in which the gas vent is mounted may be placed on the lower portion of the assembly, the complete unit then welded closed and the final assembly decontaminated. As the helium starts to form and build up pressure in the capsule, the pressure will cause the helium to diffuse through the filter into the void volume provided, and will in turn vent out small passageways in the capsule. The gas vent blocks or retains any radioactive particles and only permits helium gas to escape. Any additional assembling or installation of the heat source may then be achieved without further radiation hazard.

What is claimed is:

1. Means for use in venting gas from a container having radioactive-material therein comprising a plurality of nonporous lamina of gas impervious material with juxtaposed and coentensive surfaces in intimate and unsintered direct diffusion interbonded contact with each other up to substantially 50% of said surfaces having intermediate the lamina a zone with a network of randomly oriented minute gas passages therethrough, said diffusion bonded lamina disposed in edgewise disposition intermediate the interior and exterior of said container for release of gas from the interior.

2. The gas vent of claim 1 wherein said lamina are formed from a single member coiled about itself with juxtaposed surfaces.

3. The gas vent of claim 1 including a stack of laminae having adjoining diffusion bonded surfaces.

4. The gas vent of claim 1 wherein said bonding covers from about 4 to 10% of said surfaces.

* * * * *